US005316044A

United States Patent [19]

Szentes et al.

[11] Patent Number: 5,316,044

[45] Date of Patent: May 31, 1994

[54] HYDRAULIC CONTROL VALVE HAVING A CENTERING SPRING DEVICE

[75] Inventors: John F. Szentes; Daniel E. Zimmermann, both of Peoria; David C. Mack, Pontiac; Eric A. Hutchison, Peoria, all of Ill.

[73] Assignee: Caterpillar Inc., Peoria, Ill.

[21] Appl. No.: 986,317

[22] Filed: Dec. 7, 1992

[51] Int. Cl.[5] ..... F15B 13/04

[52] U.S. Cl. ..... 137/625.69; 137/625.65; 251/337

[58] Field of Search ..... 137/625.65, 625.69; 251/337

[56] References Cited

U.S. PATENT DOCUMENTS

| | | | |
|---|---|---|---|
| 3,434,390 | 3/1969 | Weiss | 137/625.64 X |
| 3,502,109 | 3/1970 | Straight | 137/625.64 |
| 3,511,276 | 5/1970 | Jessen et al. | 137/624.27 |
| 3,640,146 | 2/1972 | Barnes | 137/624.27 X |
| 4,041,983 | 8/1977 | Bianchetta | 137/625.66 X |
| 4,046,165 | 9/1977 | Rose et al. | 137/625.69 X |
| 4,185,660 | 1/1980 | Faix | 137/625.66 X |
| 4,195,551 | 4/1980 | Schmiel | 91/358 |
| 4,328,950 | 5/1982 | Aspinwall | 251/297 |
| 5,079,920 | 1/1992 | Whitehead et al. | 60/527 |

*Primary Examiner*—Gerald A. Michalsky
*Attorney, Agent, or Firm*—John W. Grant

[57] ABSTRACT

Centering spring devices are useful in hydraulic control valves for returning the valve to the neutral position under both normal and abnormal operating conditions. Since the actuator moving the valve spool must work against the spring centering device, electrically actuated hydraulic valves have been limited to small sizes. The subject hydraulic control valve incorporates a centering spring device that can be controllably disabled so that the valve spool can be freely moved between the neutral and operating positions. In one embodiment, a centering spring is disabled by hydraulically moving the spring retainers toward each other to compress the spring with hydraulic fluid controlled by a solenoid valve. Maintaining the spring in a compressed condition permits the valve spool to be moved with a smaller actuator thereby making it feasible to control the valve position with an electrical actuator.

6 Claims, 2 Drawing Sheets

HYDRAULIC CONTROL VALVE HAVING A CENTERING SPRING DEVICE

TECHNICAL FIELD

This invention relates to a hydraulic control valve and more particularly to a control valve having a centering spring device for returning the valve spool to its neutral position.

BACKGROUND ART

Hydraulic control valves typically have a centering spring device to return the valve spool from an operating position to a neutral position when the actuating force acting on the spool is removed. The springs of the device are assembled with a preload and has a certain rate such that as the spool is shifted from its neutral position the return force of the spring increases. The return force of the centering spring device must be sufficient to overcome the flow forces acting on the spool at the operating position and is generally quite high particularly on large valves rated at 200 to 380 liters per minute. The return force of the centering spring device constitutes a major portion of the force required to shift the spool.

The high spring force has not been a problem with pilot operated valves wherein the force required to overcome the centering spring is provided by pressurized pilot fluid. However, the spring force presents a major problem with the use of direct electrical actuators to position the valve spool. Direct electrical actuators that are required to move the spool against both the flow forces and the return force of the spring would be quite large, consume large quantities of electrical power and generate large amounts of heat.

Thus, it would be desirable to eliminate the effect of the centering spring force during a typical work cycle yet be able to reactivate that force to return the spool to the neutral position when the system is shut down or in the event the electrical power is lost.

The present invention is directed to overcoming one or more of the problems as set forth above.

DISCLOSURE OF THE INVENTION

In one aspect of the present invention, a hydraulic control valve includes a body having a bore extending therethrough, a valve spool slidably disposed in the bore and being movable between a neutral position and at least one operating position, an electrical actuator connected to the body and to the spool to move the spool between the neutral and operating positions, a centering spring device operatively disposed between the body and the spool to resiliently bias the spool to the neutral position and means responsive to a control signal for controllably disabling the centering device so that the spool can be freely moved between the neutral and operating positions.

BEST MODE FOR CARRYING OUT THE INVENTION

Figure 1:
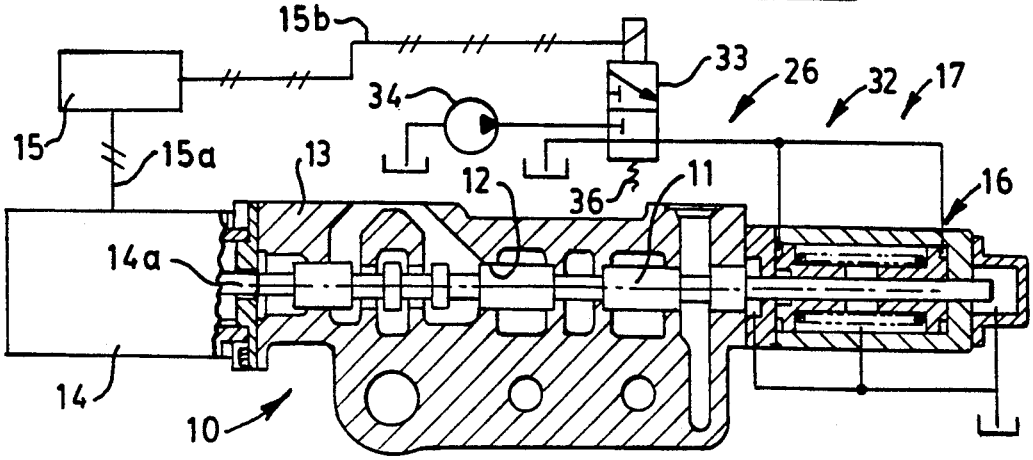
FIG. 1 is a sectional view of an embodiment of the present invention.
Figure 2:
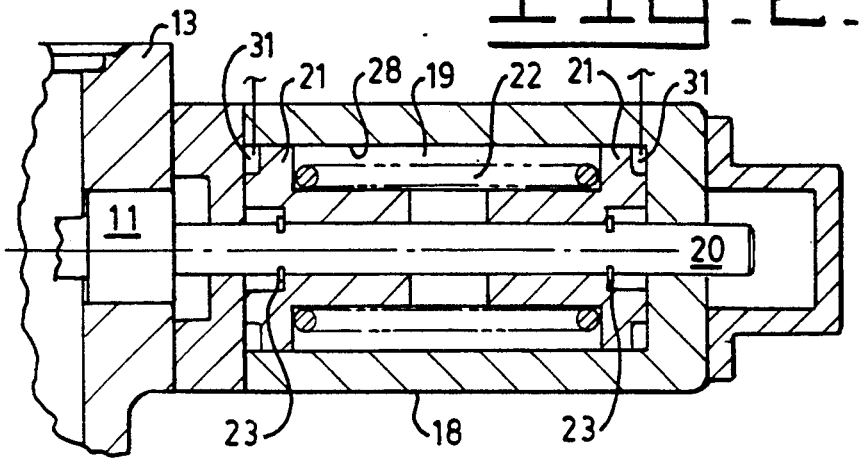
FIG. 2 is an enlarged view of a portion of FIG. 1.

As shown in FIGS. 1 and 2, a hydraulic control valve 10 includes a spool 11 slidably disposed within a bore 12 extending through a valve body 13. An electrical actuator 14 is connected to the valve body and has a movable stem 14*a* connected to the spool 11 for moving the spool between a neutral position and infinitely variable operating positions in response to receiving control signals from an electronic controller 15 through an electrical lead means 15*a*. A centering spring device 16 is operatively disposed between the body 13 and the spool 11 to resiliently bias the spool to the neutral position shown. A disabling means 17 is responsive to a control signal for controllably disabling the centering spring device 16 so that the spool is freely moveable between the neutral and operating positions.

The centering spring device 16 includes a housing 18 having a spring chamber 19 therein and suitably connected to the valve body 13. A rod 20 is connected to the spool 11 for movement therewith. A pair of spring retainers 21 reciprocatably disposed within the spring chamber 19 are slidable on the rod 20. A compression centering spring 22 disposed between the spring retainers normally urges them into engagement with the housing 18. A pair of axially spaced abutment members 23 are fixed to the rod for abutment with an associated one of the spring retainers 21.

The disabling means 17 includes means 26 for moving the spring retainers 21 axially toward each other to disengage the retainers from the housing 18 and the abutment members 23. The spring chamber 19 is defined by an axially extending bore 28 in the housing. The spring retainers 21 sealably engage the bore and the rod 20 to define a pair of actuating chambers 31 between the housing and the spring retainers.

The moving means 26 includes a means 32 for selectively introducing pressurized fluid into the actuating chambers 31 for hydraulically compressing the centering spring 22. The pressure introducing means includes a solenoid valve 33 electrically connected to the controller 15 through a lead line 15*b* and hydraulically connected to a pump 34 and to the actuating chambers 31. A spring 36 resiliently urges the solenoid, valve 33 to the position shown.

Figure 3:
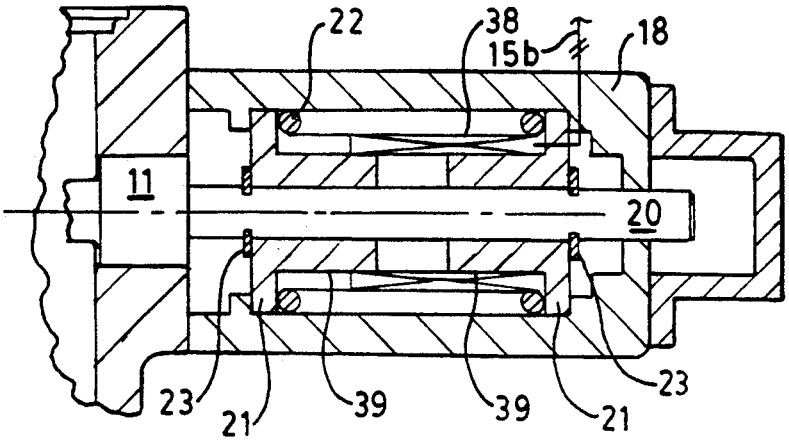
FIG. 3 is a sectional view of another embodiment of the present invention.

In the embodiment of FIG. 3, the spring retainers 21 are slidably disposed on the rod 20 and within the bore 28 but do not necessarily sealingly engage either the bore or the rod. The disabling means 17 in this embodiment includes an electromagnetic latching coil 38 circumscribing a tubular portion 39 of the spring retainers 21 and suitably electrically connected to the controller 15 through the lead line 15*b*.

Figure 4:
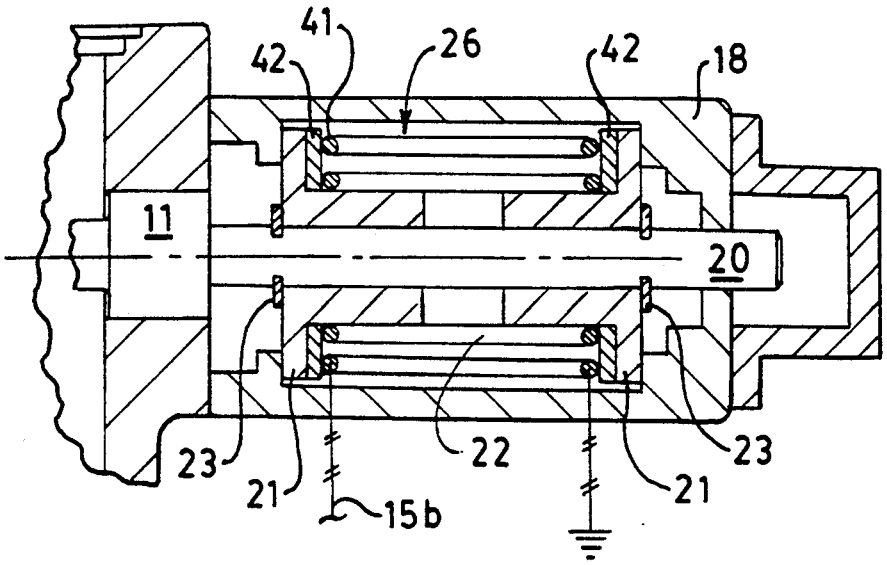
FIG. 4 is a sectional view of still another embodiment of the present invention.

In the embodiment of FIG. 4, the moving means 26 includes a tension spring 41 having its opposite ends attached to a pair of electrical insulators 42 that are suitably attached to the opposing faces of the spring retainers 21. The tension spring 41 is formed from a shape memory material of the type well known in the art. When the temperature of the tension spring made from shape memory material is below a preselected temperature the material is in a martensitic state in which the material is relatively soft and easily deformed from its original preset shape. The tension spring 41 is shown with the material in the martensitic state wherein the centering spring 22 has urged the spring retainers 21 against the housing such that the tension spring 21 has been stretched to a length somewhat greater than its preset shape. However, when the spring 21 is heated to the preselected temperature, the material is transformed into an austenitic state in which the spring returns to its original preset shape. In the process of returning to the preset shape, the tension spring builds up a mechanical force sufficient to compress the centering spring 22. The spring 41 is connected to the controller 15 via the electrical lead 15*b*. Alternatively, the spring 41 may be connected in series between the controller and the actuator 14.

Industrial Applicability

In the use of the FIG. 1 and 2 embodiment, the solenoid valve 33 receives an electrical control signal from the controller 15 whenever the controller is operating in a normal manner. The control signal energizes the solenoid valve 33 causing it to direct pressurized fluid from the pump 34 into the actuating chambers 31 to move the spring retainers 21 into abutment with each other. In so doing, the spring retainers are operatively disengaged from the abutment members 24 permitting the rod 20, and hence the spool 11 to move freely independent of the action of the centering spring 22. However, if the controller detects a fault in the system or senses an abnormal condition or the power thereto is shut off, the control signal to the solenoid valve is removed. The spring 36 thus moves the solenoid valve 33 to the position shown thereby venting the actuating chambers 1 allowing the spring 22 to move the valve spool 11 to the neutral position shown in FIG. 2.

In the use of the embodiment of FIG. 3, the coil 38 similarly receives a control signal from the controller 14 such that the latching coil 38 is energized when the controller is in operation. The latching coil 38 does not have sufficient strength to move the spring retainers 21 toward each other against the force of the spring 22. However, once the valve spool 13 is moved to a maximum operating position at which the spring retainers are in abutment with each other, the latching coil 38 can then hold the spring retainers in abutment with each other to maintain the spring 22 in the compressed condition. With the spring retainers held in this position, the valve spool 13 can be freely moved between the neutral and operating positions without any influence acting thereon by the centering device. As with the embodiment of FIG. 2, any detected system fault or abnormal condition will de-energize the latching coil 38 so that the spring 22 again becomes active to move the valve spool Il to the neutral position.

Alternatively, the latching coil 38 can be made with sufficient power to move the spring retainers 21 toward each other without having to move the spool 13 to a maximum operating position with the actuator 14.

In the use of the embodiment of FIG. 4, the controller 15 directs an electrical signal through the lead 15*b* to the tension spring 41 when the controller is operating in a normal manner. The electrical signal or current passing through the tension spring heats the spring to the preselected temperature to transform the shape memory material into the austenitic state. This causes the tension spring 41 to return to its original preset shape pulling the spring retainers 21 into abutment with each other. In so doing, the spring retainers are operatively disengaged from the abutment members 24 permitting the rod 20 and hence the spool 11 to move freely independent of centering spring 22. However, if the controller senses an abnormal condition or the power thereto is shut off, the control signal to the tension spring 41 is removed stopping the current flow therethrough. This allows the temperature of the spring 41 to drop below the preselected elevated temperature thereby allowing the centering spring 22 to move the valve spool 11 to its neutral position.

In view of the above, it is readily apparent that the subject invention provides an improved hydraulic control valve in which the centering spring device is controllably disabled so that the valve spool can be freely moved between the neutral and operating positions. Since the electrical actuator does not have to move the valve spool against the force of the centering spring, a smaller and less costly electrical actuator can be used. Also less power is required to actuate the actuator with a subsequent reduction in the heat generated.

Other aspects, objects and advantages of this invention can be obtained from a study of the drawings, the disclosure and the appended claims.

We claim:

1. A hydraulic control valve comprising:

a body having a bore extending therethrough;

a valve spool slidably disposed in the bore and being movable between a neutral position and at least one operating position;

an actuator connected to the body and to the spool to move the spool between the neutral and operating positions;

a centering spring device operatively disposed between the body and the spool to resiliently bias the spool to the neutral position, the centering spring device including a housing connected to the body and having a spring chamber therein, a rod connected to the spool, a pair of spring retainers disposed within the spring chamber and slidable on the rod, a spring disposed between the spring retainers and normally urging the retainers into engagement with the housing, a pair of axially spaced abutment members fixed to the rod for abutment with an associated one of the spring retainers; and means for controllably disabling the centering device so that the spool is freely movable between the neutral and operating positions, the disabling means including means for moving the spring retainers axially toward each other so that they are disengaged from both the housing and the abutment members.

2. The hydraulic control valve of claim 1 wherein the spring chamber is defined by an axially extending bore in the housing, and the spring retainers sealingly engage both the bore and the rod, the moving means includes hydraulic means for hydraulically moving the spring retainers toward each other.

3. The hydraulic control valve of claim 2 wherein the hydraulic moving means includes a pair of actuating chambers defined between the spring retainers and the housing, a source of pressurized hydraulic fluid, and a solenoid valve connected to both actuating chambers and the source of hydraulic fluid.

4. The hydraulic control valve of claim 1 wherein the disabling means includes a latching coil disposed between and circumscribing the spring retainers.

5. The hydraulic control valve of claim 1 wherein the moving means includes a tension spring made from a shape memory material and having its opposite ends attached to the spring retainers, and means for selectively heating the spring to a preselected temperature.

6. The hydraulic control valve of claim 5 wherein the heating means includes passing an electrical current through the tension spring.

* * * * *